US012202648B1

(12) United States Patent
Thornhill

(10) Patent No.: US 12,202,648 B1
(45) Date of Patent: Jan. 21, 2025

(54) BOTTLE STOPPER

(71) Applicant: Charles E. Thornhill, Poetry, TX (US)

(72) Inventor: Charles E. Thornhill, Poetry, TX (US)

( * ) Notice: Subject to any disclaimer, the term of this patent is extended or adjusted under 35 U.S.C. 154(b) by 0 days.

(21) Appl. No.: 18/197,973

(22) Filed: May 16, 2023

Related U.S. Application Data

(60) Provisional application No. 63/349,707, filed on Jun. 7, 2022.

(51) Int. Cl.
*B65D 39/16* (2006.01)
*B65D 39/00* (2006.01)

(52) U.S. Cl.
CPC ..... *B65D 39/16* (2013.01); *B65D 39/0005* (2013.01)

(58) Field of Classification Search
CPC ..... B65D 39/16; B65D 39/0005
USPC ..... 215/355; D9/438, 439
See application file for complete search history.

(56) References Cited

U.S. PATENT DOCUMENTS 639,693 A * 12/1899 Bready ..... B65D 39/16 215/364
730,878 A * 6/1903 Clubb ..... B65D 39/16 215/299
872,485 A * 12/1907 Watt ..... B65D 39/16 215/300
3,034,680 A * 5/1962 Steinberg ..... B65D 51/20 220/276
3,271,900 A * 9/1966 Sakae ..... A01G 31/02 47/80
4,647,638 A * 3/1987 Yokoshima ..... C07F 9/091 252/186.42
4,682,702 A * 7/1987 Gach ..... B65D 51/20 222/541.9
5,109,997 A 5/1992 Phillips
5,560,969 A * 10/1996 Portas ..... F16G 11/025 138/155
5,636,757 A 1/1997 Porvaznik
5,741,015 A * 4/1998 Skinner ..... E04G 15/061 285/23
5,944,929 A * 8/1999 Vallauri ..... B29C 48/07 156/162
6,168,036 B1 1/2001 Teng
7,533,781 B1 5/2009 Spooner
8,960,466 B2 * 2/2015 Golden ..... B65D 51/2807 53/489

(Continued)

FOREIGN PATENT DOCUMENTS

CN 202080526 12/2011
GB 2280895 2/1995

(Continued)

*Primary Examiner* — J. Gregory Pickett
*Assistant Examiner* — Niki M Eloshway
(74) *Attorney, Agent, or Firm* — Kenneth L. Tolar

(57) ABSTRACT

A bottle stopper includes an elongated band formed of a thin paper, plastic, or similar material. The band is tightly wound into a compact cylinder that is dimensioned and configured to firmly seat within a bottle neck opening. Preferably, the cylinder includes an outer liner of food-grade material that prevents the cork from contaminating the enclosed wine. A cord is attached to the central core of the resulting compact cylinder and extends a predetermined distance above the bottle neck. When the cord is pulled, the band unwinds into a helical configuration that easily separates from the bottle neck.

6 Claims, 3 Drawing Sheets

(56) References Cited

U.S. PATENT DOCUMENTS

| | | | | |
|---|---|---|---|---|
| 9,302,833 | B1 * | 4/2016 | Faye | B65D 47/40 |
| D810,564 | S * | 2/2018 | Wei | D9/438 |
| 10,021,958 | B2 * | 7/2018 | Votel | A45F 5/00 |
| 11,760,541 | B2 * | 9/2023 | Fricano | B65D 39/0029 215/355 |
| 2006/0043055 | A1 * | 3/2006 | Wang | B65D 39/0058 215/355 |
| 2013/0328232 | A1 * | 12/2013 | Bost | B65D 39/0029 264/148 |

FOREIGN PATENT DOCUMENTS

| | | |
|---|---|---|
| KR | 20100012292 | 12/2010 |
| KR | 20160001445 | 5/2016 |
| WO | WO 2006/077603 | 7/2006 |

* cited by examiner

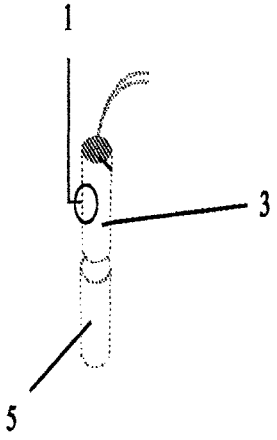
FIG. 1
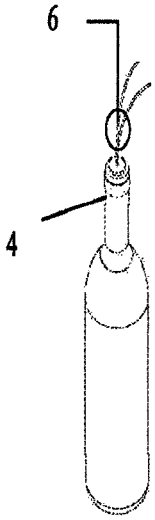
FIG. 2
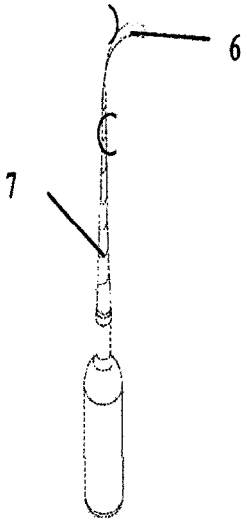
FIG. 3
FIG. 4
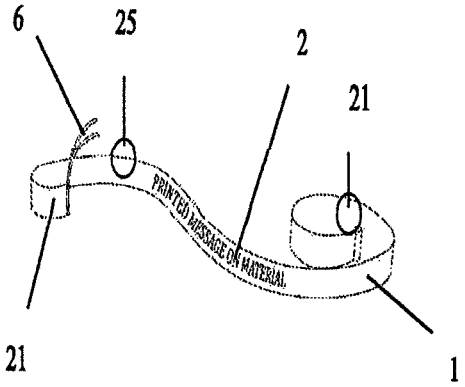

BOTTLE STOPPER

CROSS REFERENCE TO RELATED APPLICATIONS

This application claims priority of provisional application No. 63/349,707 filed on Jun. 7, 2022, the specification of which is incorporated herein by reference.

BACKGROUND OF THE INVENTION

The present invention relates to a bottle stopper that can be easily removed without a corkscrew or other tools.

DESCRIPTION OF THE PRIOR ART

Traditional corks have been used to seal bottled wines and other beverages for thousands of years. Bottle corks are typically constructed with the bark of a cork oak tree since its porosity allows a minimal amount of air to interact with the wine, which facilitates proper aging and improves aroma and flavor. Though extremely effective at preserving wine quality, conventional corks must be removed with a corkscrew. However, accessing a corkscrew when camping, tailgating, traveling, or engaging in similar activity can be difficult. Removing the cork with another tool such as a knife can shear the cork, causing fragments to fall into the wine. Screw caps require no tools but prevent oxygen permeation which many believe eliminates the benefits described above. Moreover, many wine purists simply prefer traditional corks.

Accordingly, there is currently a need for a bottle stopper that is slightly porous as with a traditional cork but can be removed without a corkscrew. A review of the prior reveals no bottle stoppers that adequately address the above-described problems. For example, U.S. Pat. No. 5,109,997 to Phillips discloses a bottle stopper having an expandible plug to prevent inadvertent removal.

U.S. Pat. No. 5,636,757 to Porvaznik discloses a bottle cork having an integral handle mechanism to allow removal without a corkscrew.

U.S. Pat. No. 6,168,036 to Teng discloses a corkscrew-free bottle stopper including a hollow cylinder with a plug slidably received therein. A handle moves the plug into and out of a bottle dispensing opening.

U.S. Pat. No. 7,533,781 to Spooner discloses an improved cork having a recess on a top surface for receiving and guiding a corkscrew.

International patent publication no. WO 2006/077603 to Morandi discloses a self-uncorking bottle cap including a pair of threaded cooperating components.

Korean patent publication no. KR 2010001129 discloses a bottle cork with an integral pull cord.

Though some prior-art corks can be removed with an integral handle, substantial force is required. Moreover, the prior-art devices are complex and constructed with numerous expensive components. The present device overcomes the deficiencies of the prior art by providing a cork formed of a thin pliable material that is tightly wound into a cylinder to plug a bottle opening. When an attached cord is pulled, the cylinder unfurls and releases from the bottle.

SUMMARY OF THE INVENTION

A bottle stopper includes an elongated band formed of a thin paper, plastic, or similar material. The band is tightly wound into a compact cylinder that is dimensioned and configured to firmly seat within a bottle neck opening. Preferably, the cylinder includes an outer liner of food-grade material that prevents the cork from contaminating the enclosed wine and from absorbing the wine by capillary action. A cord is attached to the band and extends a predetermined distance above the bottle neck. When the cord is pulled, the band unfurls into a helical configuration that easily releases from the bottle neck.

It is therefore an object of the present invention to provide a bottle stopper that can be easily removed without a corkscrew or other tool.

It is therefore another object of the present invention to provide a cork that is easily removable with an attached cord.

It is therefore yet another object of the present invention to provide a cork that forms an inspirational banner when removed.

Other objects, features, and advantages of the present invention will become readily apparent from the following detailed description of the preferred embodiment when considered with the attached drawings and the appended claims.

BRIEF DESCRIPTION OF THE DRAWINGS

FIG. 1 is a perspective, slightly exploded view of the cork according to the present invention.

FIG. 2 depicts the stopper installed within a bottle.

FIG. 3 depicts the stopper being removed from a bottle.

FIG. 4 depicts the stopper completely unwound to form a banner depicting an inspirational message.

DESCRIPTION OF THE PREFERRED EMBODIMENT

Figure 5:
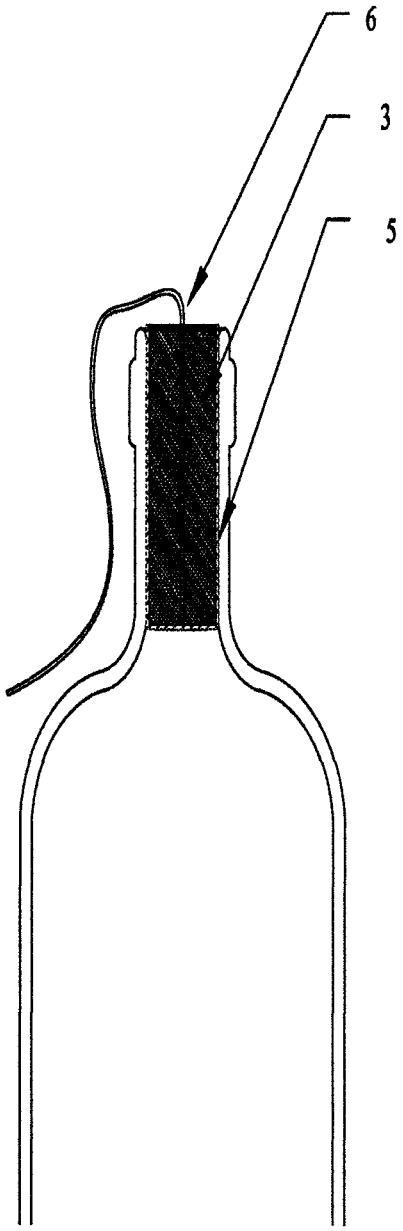
FIG. 5 is a sectional view of a bottle with the bottle stopper positioned therein.

An improved bottle stopper includes an elongated band I formed of a thin paper, plastic, or similar pliable material. The band includes a front surface, a rear surface, a first end 20 and a second end 21. Either the front and/or rear surface includes an inspirational message, a holiday recognition, or other indicia 2 commemorating a special event. Therefore, when the band is removed from a bottle, it forms a banner 25 that can be prominently displayed on a desired surface. The band is tightly wound into a compact cylindrical scroll 3 that is dimensioned and configured to firmly seat within a bottle neck opening 4.

Attached to the first end 20 of the band is a tube 5 having a continuous outer wall, a closed bottom end and an open top. The tube is formed of a food-grade, liquid-impermeable material that prevents the stopper from contaminating the enclosed wine and from absorbing the wine due to capillary action. After the band is rolled into the cylindrical scroll, it is positioned within the tube forms a tight seal between the scroll and the bottle neck.

A cord 6 attached to the second end of the band is positioned within the core of the resulting scroll and extends a predetermined distance above the bottle neck. A distal end of the cord may include a handgrip, such as a ring, a bar, a handle, or similar mechanism that a user grasps when removing the stopper. When the cord is pulled, the band unwinds into a helical configuration 7 that easily separates from the bottle neck. The band is then unfurled to form an inspirational banner that can be prominently displayed on a desired surface.

Figure 6:
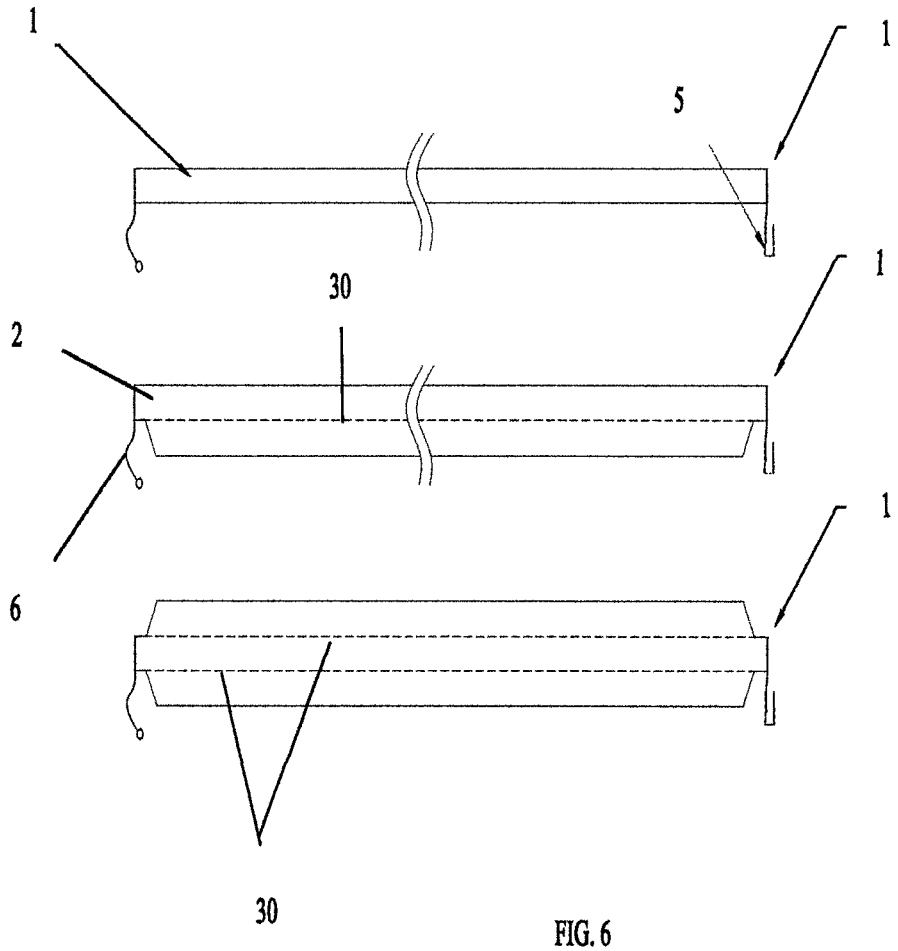
FIG. 6 depicts a slightly different embodiment of the band.

Now referring to FIG. 6, the band could have one or more longitudinal fold lines 30 that allow the thickness of the band to be increased according to a particular application. For example, if the band is folded in half, its thickness is doubled, and the requisite length of the band is reduced by one half, thereby creating a shorter, wider banner for display.

The above-described device is not limited to the exact details of construction and enumeration of parts provided herein. Furthermore, the size, shape, and materials of construction of the various components can be varied without departing from the spirit of the present invention.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

The invention claimed is:

1. An improved bottle stopper comprising:

an elongated, pliable band having a front surface and a rear surface, said band wound into a compact cylindrical scroll that is dimensioned and configured to plug a bottle neck opening;

a cord attached to a first end of said band that is positioned within a central innermost portion of the compact cylindrical scroll and extends a predetermined distance above the bottle neck;

a tube on a second end of said band, said tube constructed with a food-grade, liquid-impermeable material that prevents the bottle stopper from contaminating a beverage and from absorbing the wine by capillary action, and assures a liquid-impermeable seal between the scroll and a bottle neck.

2. The improved bottle stopper according to claim 1 wherein said band includes a front surface and a rear surface, either of said front surface and said rear surface including indicia commemorating a special event.

3. The improved bottle stopper according to claim 1 including a handgrip at a distal end of said cord that a user grasps to pull the cord and release said compact cylindrical scroll from a bottle neck.

4. In combination with a bottle having a neck and an opening on said neck for dispensing a contained beverage, an improved bottle stopper comprising:

an elongated, pliable band having a front surface and a rear surface, said band wound into a compact cylindrical scroll that is dimensioned and configured to plug said opening;

a cord attached to a first end of said band that is positioned within a central innermost portion of the compact cylindrical scroll and extends a predetermined distance above the bottle neck;

a tube on a second end of said band, said tube constructed with a food-grade, liquid-impermeable material that prevents the cork from contaminating a beverage and from absorbing the wine by capillary action, and assures a liquid-impermeable seal between the compact cylindrical scroll and the neck.

5. The improved bottle stopper according to claim 4 wherein said band includes a front surface and a rear surface, either of said front surface and said rear surface including indicia commemorating a special event.

6. The improved bottle stopper according to claim 4 including a handgrip at a distal end of said cord that a user grasps to pull the cord and release said compact cylindrical scroll from said neck.

* * * * *